US007360385B1

(12) United States Patent
Wohlenhaus et al.

(10) Patent No.: US 7,360,385 B1
(45) Date of Patent: Apr. 22, 2008

(54) QUICK CHANGE BEND TOOLING BOLSTER

(75) Inventors: Douglas T. Wohlenhaus, Flushing, MI (US); Arturo M. Martinez, Clarkston, MI (US); Michael H. Lovell, Leonard, MI (US); Mark A. Cline, Clarkston, MI (US); David R. Friddell, Grand Blanc, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/736,169

(22) Filed: Apr. 17, 2007

(51) Int. Cl.
*B21D 9/05* (2006.01)

(52) U.S. Cl. ..... 72/150; 72/149; 72/158

(58) Field of Classification Search ..... 72/149, 72/150, 157, 158
See application file for complete search history.

(56) References Cited

U.S. PATENT DOCUMENTS 3,147,792 A * 9/1964 Hautau ..... 72/150
3,657,911 A * 4/1972 Clarke et al. ..... 72/157
4,843,858 A * 7/1989 Grimm et al. ..... 72/149
4,959,984 A * 10/1990 Trudell et al. ..... 72/19.9
5,042,279 A * 8/1991 Togoshi ..... 72/29.2
5,337,590 A * 8/1994 Schuchert et al. ..... 72/157
5,463,888 A * 11/1995 Nagai ..... 72/157
5,689,988 A * 11/1997 Schwarze ..... 72/157
2004/0200253 A1* 10/2004 Schmauder et al. ..... 72/149

* cited by examiner

*Primary Examiner*—Dmitry Suhol

(57) ABSTRACT

A tube bending assembly adapted for use with a rotary draw bender, and preferably including a bend die mounting unit for securing a plurality of stacked bend dies drivenly coupled to the bender, a bend die tower unit for structurally supporting the bend die mounting unit, a wiper die mounting unit for securing a wiper die adjacent a selected bend die, a clamp die mounting unit for positioning and securing a clamp die, a pressure die mounting unit for securing a pressure die adjacent the clamp die, a mandrel saddle unit for positioning and enabling the utilization of a mandrel assembly, a collet saddle unit for positioning and enabling the utilization of a collet, and a bolster unit that interconnects the units, so as to present an integrated assembly capable of concurrent disconnection from and connection to the bender, and thereby reducing the tool set change-over period.

17 Claims, 10 Drawing Sheets

FIG. 10
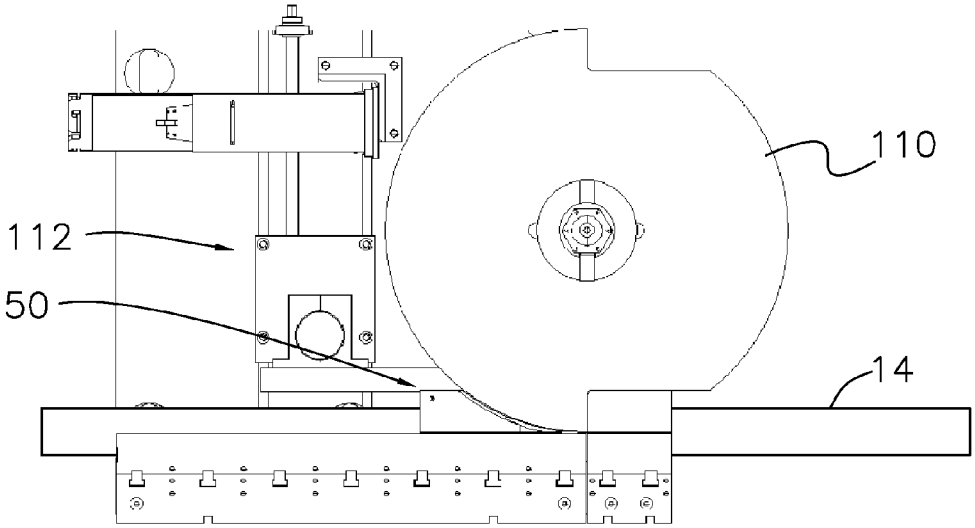
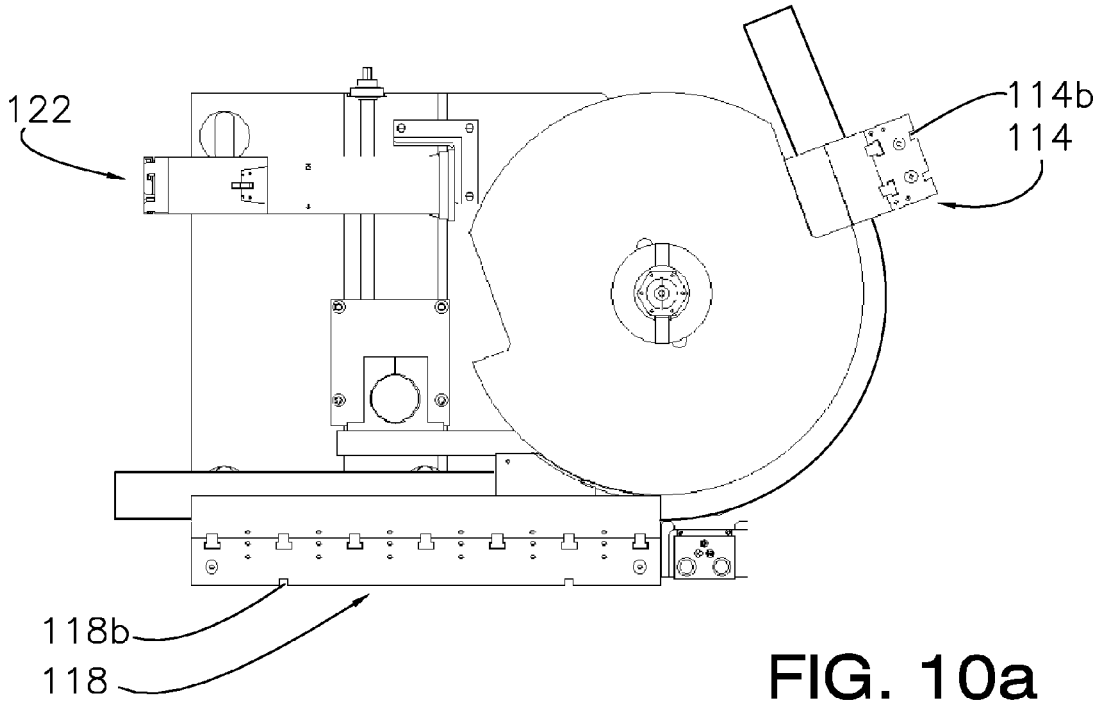
FIG. 10a

FIG. 12
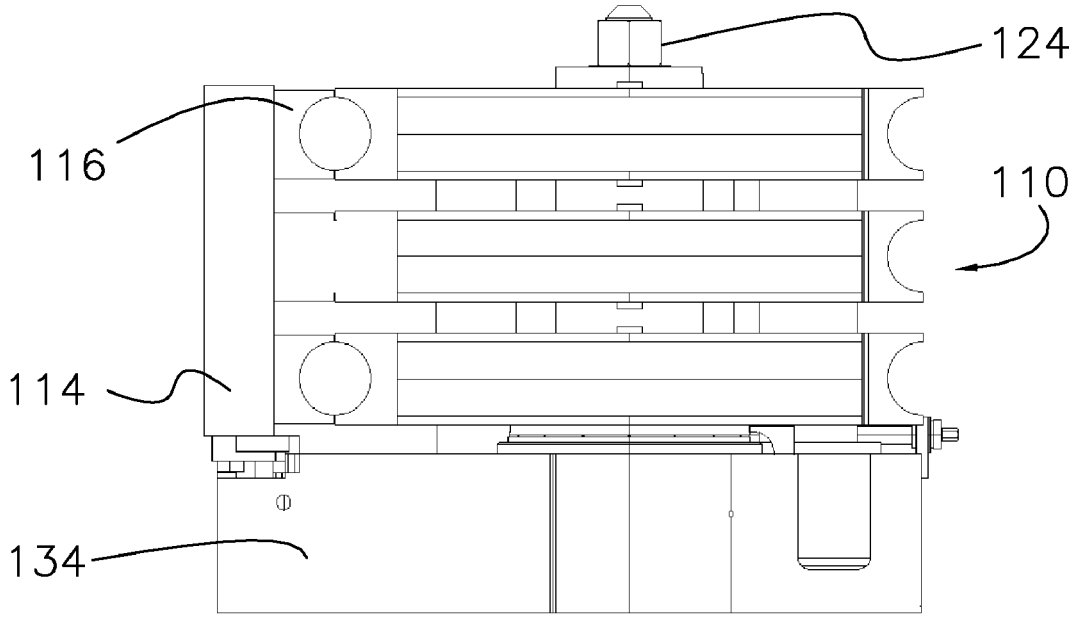
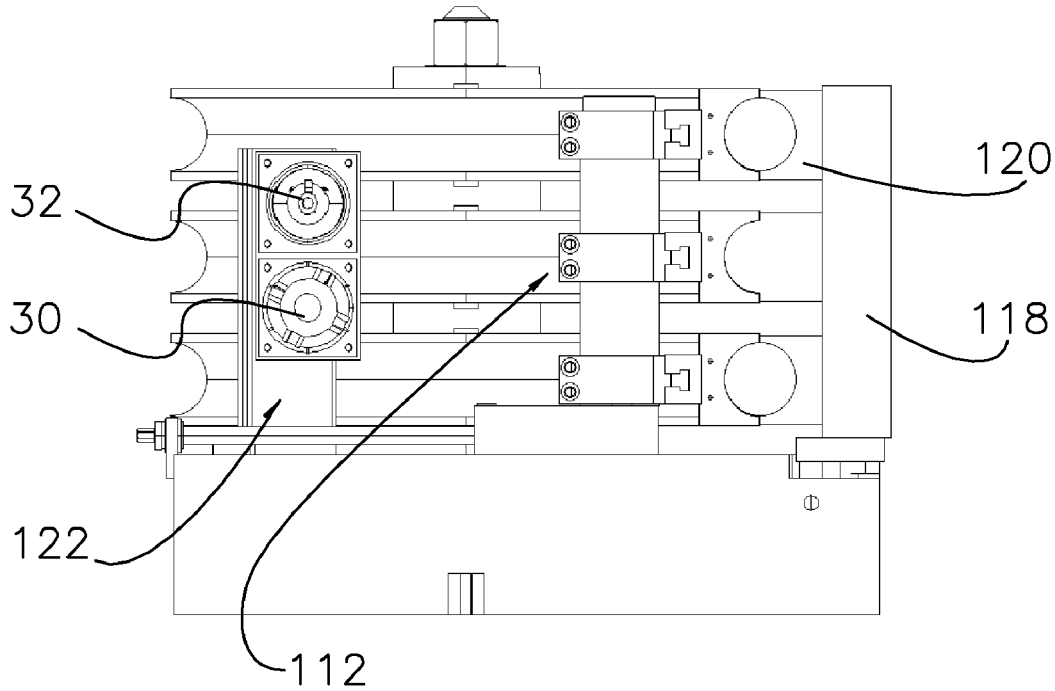
FIG. 12a

QUICK CHANGE BEND TOOLING BOLSTER

FIELD OF THE INVENTION

The present invention relates generally to tube bending machines and tooling sets. More particularly, the invention concerns an assembly configured to facilitate the proper positioning, interconnection, and retention of a complete bend tooling set for quick connection to and disconnection from a tube bending machine.

BACKGROUND OF THE INVENTION

Conventional tube-bending machines or benders primarily employ compression, press and rotary draw methods to bend tubes along circular arcs. These machines and methods are commonly utilized in various industrial applications, including automobile and aircraft assembly, and equipment/conduit manufacture. These machines typically include a series of dies and a drive mechanism that cooperate to impart pressure upon a tube, so that the tube bends to a predetermined form. More particularly, with respect to rotary draw bending, a bend die is positioned adjacent the desired section of the tube. The tube is held in place and pressure is applied to the tube by clamping and pressure dies. A wiper die is further provided so that the tube conforms to the profile defined by the bend die with minimal deformation. To facilitate the production of a compound bend (i.e., a bend comprising multiple sections having differing radii and/or orientation), a stacked plurality of bend dies is often provided, wherein each die presents a different bending radius. In this configuration, the tube is shifted amongst the individual bend dies to effect the compound bend, thereby avoiding the need to disconnect the existing components, and connect new components to (i.e., change-over) the machine.

Where sequential singular or compound bends of differing radii, orientation or combinations thereof are desired, individual units of the bending tool set, including the bend, wiper, pressure, and/or clamping dies, must be replaced and/or repositioned, irrespective of a stacked configuration. The change-over period results in considerable down-time to the machine, as well as additional labor costs. In a repetitive environment, such as an assembly-line process, the costs associated with change-over periods present increasingly significant concerns; especially given that a typical change over of a complete tool set may take up to four hours of down-time per machine.

In automotive manufacturing, for example, change-over concerns are particularly presented by hydroform tube production, which utilizes conventional tube bending to effect pre-hydroform bends on dedicated single bend configuration lines. As hydroform technology is increasingly implemented on low and medium volume vehicles, the variety of bends encountered and bender use demands have likewise increased. As a result, the percentage of tube bending configurations that can be manufactured on one bender before requiring a complete tooling change has become increasingly limited.

To reduce costs associated with change-over, some bender manufacturers offer quick-change options for individual tooling details. Even with these provisions, however, significant change-over periods and labor costs persist. Accordingly, there remains a need in the art for an improved method of or apparatus for reducing the change-over period of bending machines, and otherwise increasing the flexibility of the bending process.

BRIEF SUMMARY OF THE INVENTION

Responsive to this need, the present invention provides an assembly of properly positioned and interconnected tube bending components adapted for use with conventional tube bending machines. The assembly enables the concurrent connection and disconnection of the entire assembly to and from the machine, thereby resulting in drastically reduced change-over periods relative to conventional tool bending processes. Among other things, the invention is further useful for facilitating the production of more complex bent tube geometries having multi-compound bends, and for allowing off-line bend tool set-up.

In general, the assembly includes bend die mounting, clamp die mounting, pressure die mounting, wiper die mounting, and bolster units. The bend die mounting unit is configured to secure at least one bend die in a fixed position relative thereto, and is drivenly coupled to the machine, so as to be rotated thereby, when the assembly is connected to the machine. The clamp die mounting unit is configured to secure a clamp die in a fixed position, wherein the clamp die is operable to produce a holding force against the tube. The pressure die mounting unit is configured to secure a pressure die in a fixed position generally adjacent the clamp die. The wiper die mounting unit is configured to secure at least one wiper die in a fixed position opposite the pressure die. The bolster unit is rotatably coupled to the bend die mounting unit, fixedly connected to the clamp die mounting, pressure die mounting, and wiper die mounting units, and removably connectable to the machine, so as to enable the connection or disconnection of the machine and assembly as a whole. Finally, the bend, clamp, pressure, and wiper dies are cooperatively configured to hold the tube in the operable position, cause the tube to bend, and control tube stretching and surface deformation during bending, when the assembly is connected to the machine and the machine is actuated.

Other aspects of the present invention concern the inclusion of a plurality of bend dies having differing radii, and the wiper die mounting unit being configured to adjustably position the wiper die adjacent a selected one of the bend dies without disconnecting the wiper die mounting unit from the bolster unit. Further aspects include the use of mandrel and collet saddle units that are properly located and partially defined by the bolster unit. Finally, where the bend die mounting unit includes a tooling post configured to secure the plurality of bend dies in a stacked configuration, the assembly preferably includes a bend die tower unit for supporting the distal end of the post during clamping and bending.

It will be understood and appreciated that the present invention provides a number of advantages over the prior art including drastic reductions in change-over periods experienced, better utilization of bender capacity, and reduction in capital equipment cost for low volume hydroform parts. Yet further aspects, embodiments, and advantages of the present invention will be apparent from the following detailed description of the preferred embodiment(s) and the accompanying drawing figures.

BRIEF DESCRIPTION OF THE SEVERAL VIEWS OF THE DRAWING

A preferred embodiment(s) of the invention is described in detail below with reference to the attached drawing figures, wherein:

FIG. 10 is a plan view of a tool bending assembly in accordance with the second preferred embodiment of the invention, and an operably positioned tube in an unbent condition;

FIG. 10*a* is a plan view of the assembly, and tube shown in FIG. 10, particularly illustrating a portion of the assembly, including the clamp and bend dies, having undergone a degree of rotation, and the tube in a bent condition resulting therefrom;

FIG. 12 is a front elevation view of the assembly shown in FIG. 8, particularly illustrating clamp die mounting, bend die mounting and bolster plate units; and FIG. 12*a* is a rear elevation view of the assembly shown in FIG. 8, particularly illustrating the bend die stack, mandrel and collet mounting unit, pressure die mounting unit, wiper die mounting unit, and their respective dies.

DETAILED DESCRIPTION OF THE INVENTION

As shown in FIGS. 1 through 12, the present invention concerns novel tube bending assemblies 10,100 adapted for use with a rotary draw tube bending machine or bender 12 (FIG. 3), such as a computer-numerically-controlled (CNC), numerically-controlled (NC), or conventional type tube bender. As is well known in the art, the rotary draw bender 12 functions to compress a tube 14 against a bending profile, so that the point at which bending takes place is stationary and the profile lies tangential to the incoming line of the tube 14 (compare FIGS. 3 and 3*a*, and 10 and 10*a*). Typically, to achieve this end the bender 12 rotates a bend die and utilizes a series of other dies to hold and apply pressure to the tube. The bender 12 may utilize a manual, mechanically assisted manual, electrical, hydraulic, or electro-hydraulic drive system to effect rotational displacement. The preferred assemblies 10,100 are described and illustrated herein, with respect to rotary draw bending; however, it is well within the ambit of the present invention to utilize the aspects and benefits of the assemblies 10,100 with other conventional tube-bending methods, such as compression, ram, roll, or press bending, or where a plurality of components or dies are necessarily changed over when making bends of differing configuration.

The tube 14 is formed by an endless wall that defines an outer diameter (o.d.), an inner diameter (i.d.), a corresponding tube wall thickness, W, first and second open ends linearly separated by a longitudinal tube length, L, and a central axis. The tube 14 is formed of a material having suitable strength to enable bending, but prevent undue deformation under normally applied bending force vectors, including aluminum, stainless steel, copper (Type K and L), and poly-butyrene (PB). Finally, it is also within the ambit of the invention for the assemblies 10,100 to be utilized and/or modified to bend other conventional members, such as square tubing, finned tubing, pipe, flat stock, Chromolly, and solid rod; and it is appreciated that the structural and operational limits of the assemblies 10,100 are set in part by the characteristics of the tube 14 or member to be bent.

Figure 1:
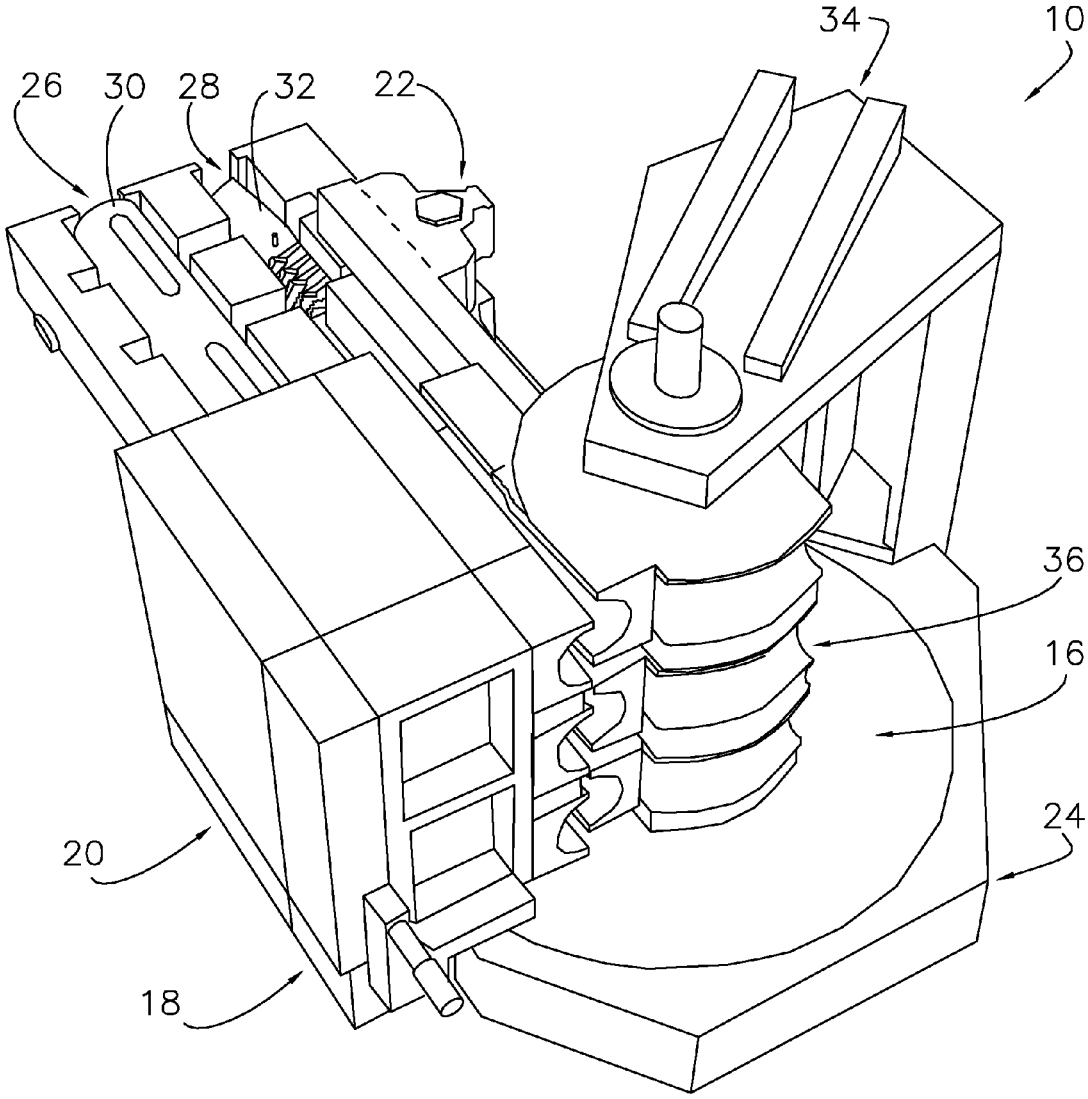
FIG. 1 is a perspective view of a tool bending assembly for use with a rotary draw bender, in accordance with a first preferred embodiment of the invention.

Turning to the configuration of assembly 10 (FIGS. 1 through 7), a complete bending tool set is secured by a plurality of units, and a novel means for interconnecting the units, so as to make the assembly 10 an integrated structure (FIG. 1). As previously mentioned, it is appreciated by those of ordinary skill in the art that the integration of the tool set components enables their concurrent disconnection or connection, so that the change-over period for replacing the complete tool set is reduced. This is advantageous, for example, where it is desired to draw a subsequent compound bend having a different compound radii or orientation. Since the units are pre-positioned for proper operation, it is also appreciated that the period is further reduced by eliminating the reoccurring need to properly position and align the individual units during each change-over.

Figure 2:
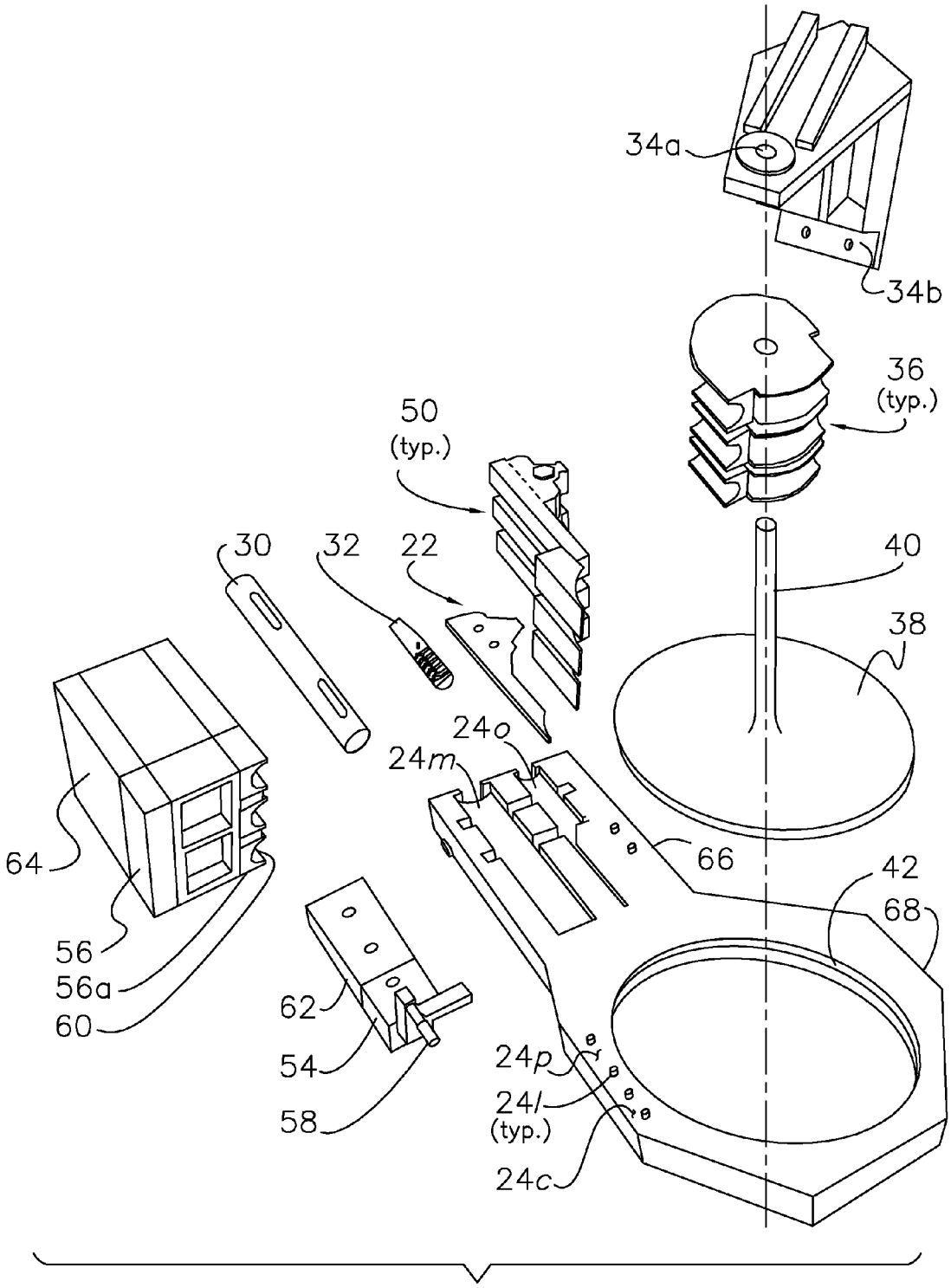
FIG. 2 is an exploded view of the assembly shown in FIG. 1, particularly illustrating the interrelation of a bend die mounting unit, bend die tower unit, bolster unit, clamp die mounting unit, wiper die mounting unit, pressure die mounting unit, mandrel saddle unit, collet saddle unit, and their respective dies.
Figure 3:
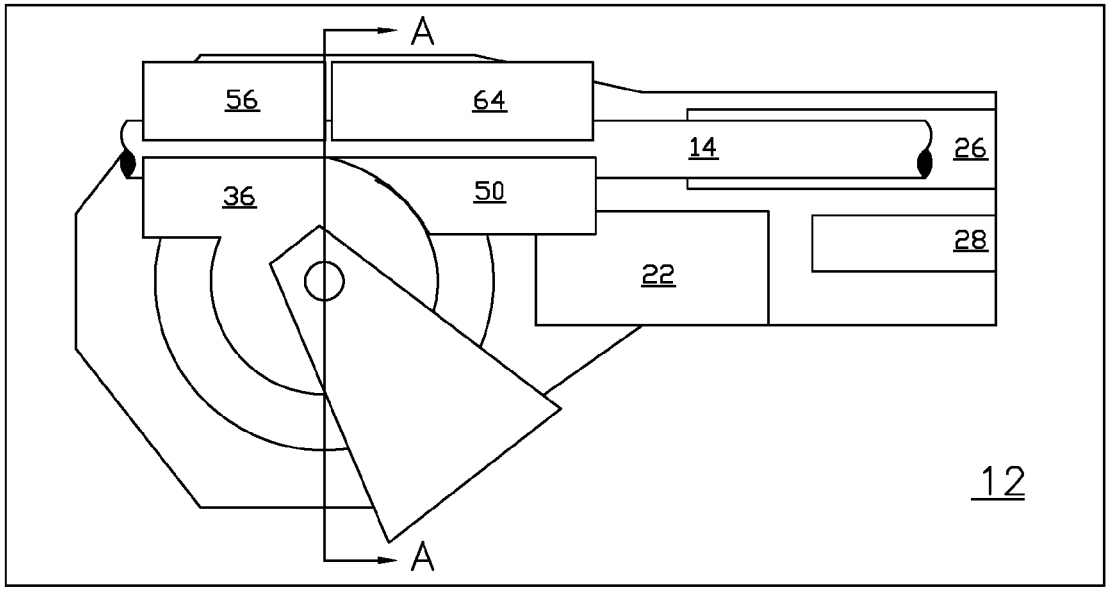
FIG. 3 is a plan view of a tool bending assembly in accordance with a preferred embodiment of the invention, a rotary draw bender, and an operably positioned tube in an unbent condition.
Figure 3A:
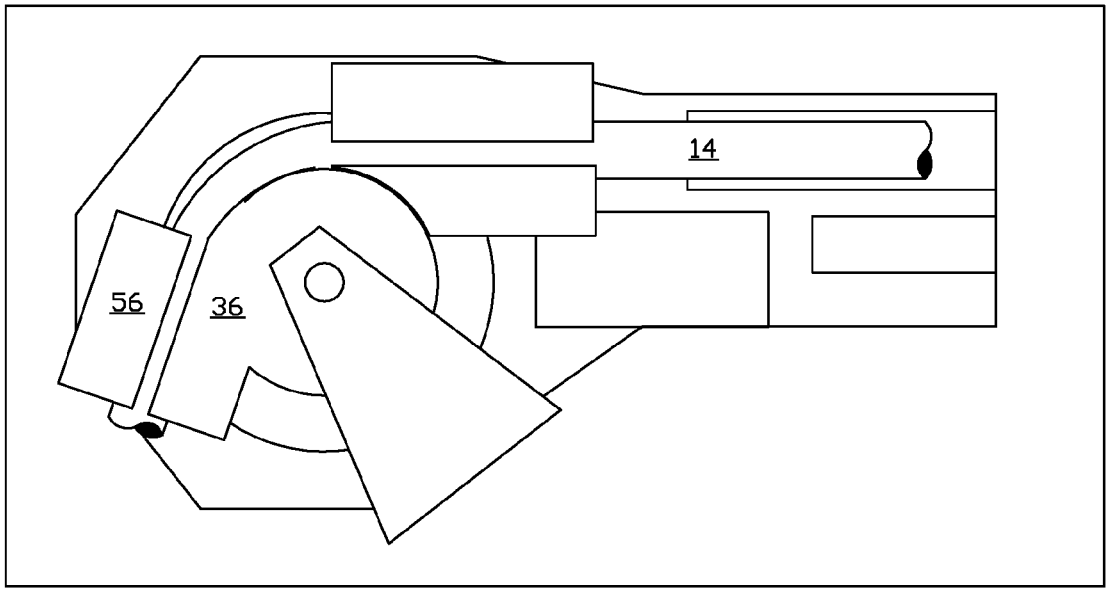
FIG. 3*a* is a plan view of the assembly, bender, and tube shown in FIG. 3, particularly illustrating a portion of the assembly, including the clamp and bend dies, having undergone a degree of rotation, and the tube in a bent condition resulting therefrom.

As best shown in FIG. 2, the assembly 10 includes a bend die (or draw die) mounting unit 16, a clamp die mounting unit 18, a pressure die (or follower die) mounting unit 20, and a wiper die mounting unit 22. All of which are configured to secure a respective die in an operable position relative to the tube 14. As shown in FIGS. 3 and 3*a*, the dies are preferably oriented to form an interlocked position to deter slippage or misalignment during bending. A novel bolster unit 24 is rotatably coupled to the bend die mounting unit 16, shiftably connected to the clamp die and pressure die mounting units 18,20, and fixedly connected to the wiper die mounting unit 22, so as to interconnect the units 16-20 (FIG. 1). More preferably, a mandrel saddle unit 26 and a collet saddle unit 28 are also fixedly connected to and partially defined by the bolster unit 24, and configured to secure a mandrel assembly 30 and collet 32 in proper positions for use during bending. Finally, and more preferably, a bend die tower unit 34 is fixedly connected to the bolster unit 24, rotatably coupled to the bend die mounting unit 16, and configured to provide structural support to the bend die mounting unit 16.

Figure 4:
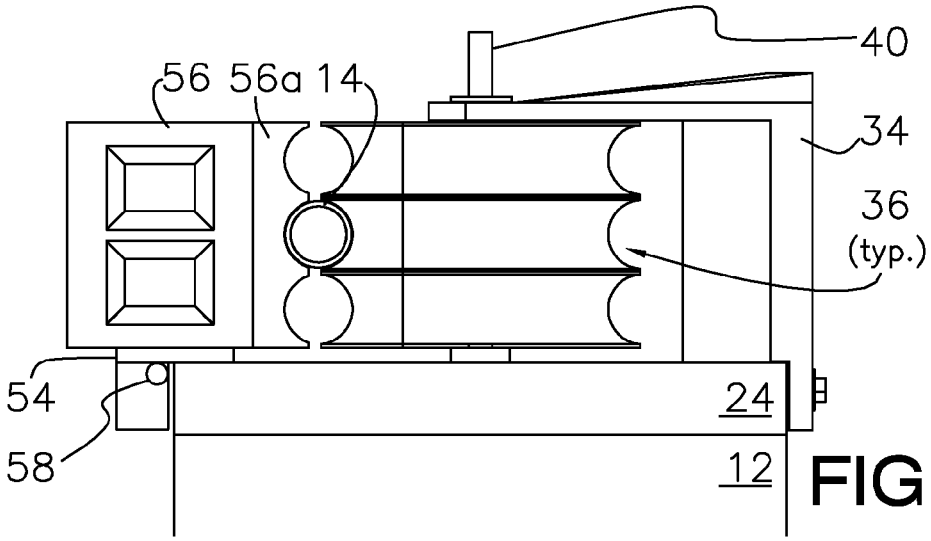
FIG. 4 is a generalized front elevation view of an assembly and bender, in accordance with a preferred embodiment of the invention.
Figure 5:
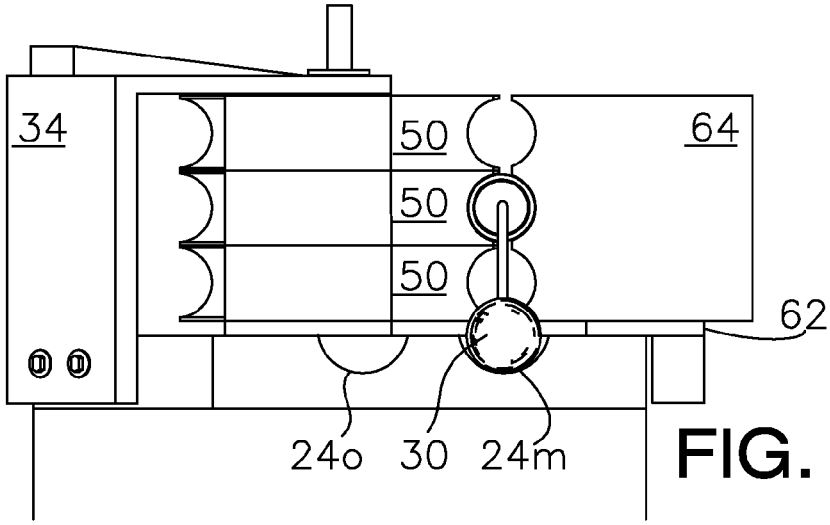
FIG. 5 is a generalized back elevation view of an assembly and bender in accordance with a preferred embodiment of the invention, wherein a plurality of wiper dies are positioned by the wiper die mounting unit.
Figure 5A:
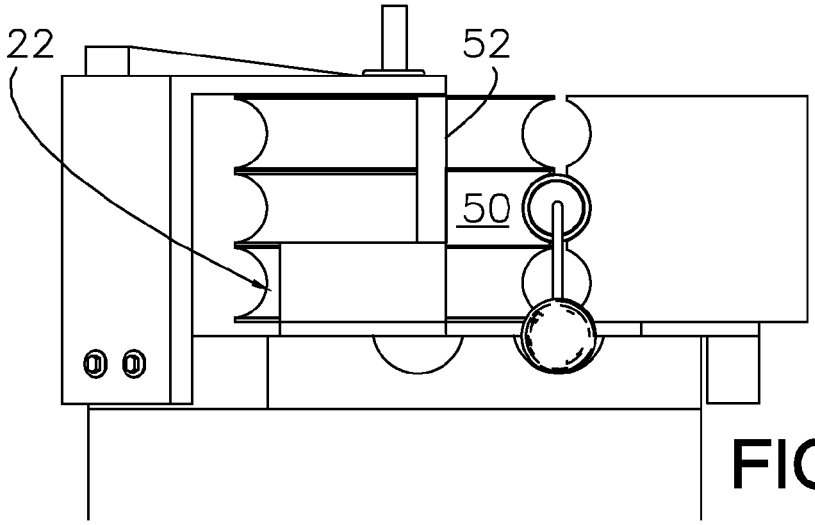
FIG. 5*a* is a generalized back elevation view of a preferred embodiment of the assembly, wherein the wiper die mounting unit includes an adjustment mechanism for raising or lowering a wiper die to a selected one of a plurality of bend dies.

FIGS. 4, 5, and 5*a* further illustrate the interrelationship of the various units of the assembly 10. FIG. 4 presents a generalized front elevation view of a triple stack clamp and bend die configuration in an engaged condition, wherein the tube 14 is acted upon by the intermediate clamp and bend dies. FIGS. 5 and 5*a* show alternative embodiments of the wiper die mounting unit 22, which are further discussed herein. To facilitate repair, interchangeability, replacement and/or adjustment, the individual units 16-22,26,28 and 34 are preferably removably connected (e.g., magnetized, pinned, bolted) to the bolster unit 24.

Figure 6:
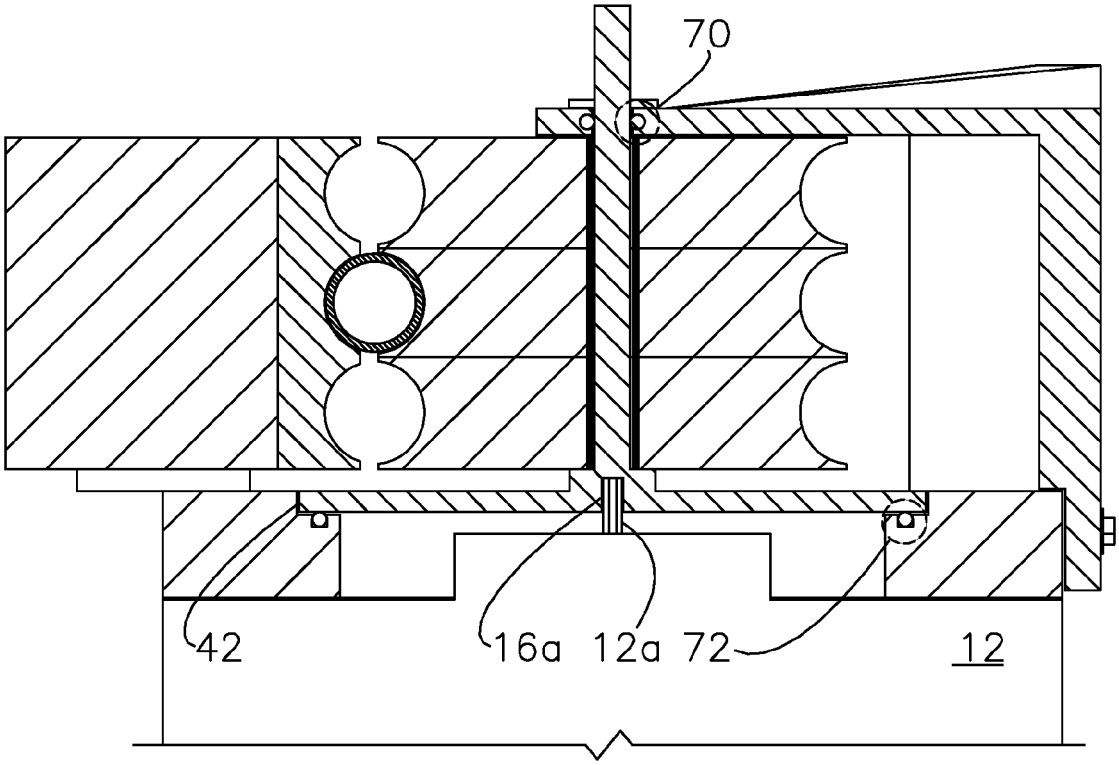
FIG. 6 is a cross-section of the assembly shown in FIG. 3, as taken along line A-A, wherein first and second bearing sets are intermediate the bend die mounting and tower units, and the bend die mounting and bolster units, respectively.

More particularly, the bend die mounting unit 16 is configured to secure at least one, and more preferably, a plurality of bend dies 36 in a fixed position relative thereto, so that each bend die 36 is able to sustain a clamping and bending force as it rotates. As best shown in FIG. 6, when the assembly 10 is connected to the bender 12, the bend die mounting unit 16 is drivenly coupled to a drive mechanism 12*a* of the bender 12, so as to be caused to rotate thereby. For example, the bend die mounting unit 16 may define a keyed receptacle 16*a* that tightly receives the C-axis of the drive mechanism 12*a*, so as to form superjacent layers therewith.

As such, the preferred bend die mounting unit 16 includes a tooling plate 38 and tooling post 40 (FIG. 2), wherein the plate 38 and post 40 may be integrally formed as illustrated. The tooling plate 38 presents a circular planar sheet that sits within a congruently shaped through-hole inset 42 defined by the bolster unit 24. As is necessary for the proper function of the invention, the mechanism 12*a* and plate 38 are cooperatively configured to transmit the bending torque to the die 36 and tube 14. As best shown in FIG. 6, the preferred inset 42 and tooling plate 38 are cooperatively configured such that the top surfaces of the plate 38 and bolster unit 24 are generally flush, when the plate 38 is inserted therein. The diameter of the plate 38 is preferably within 95 to 99 percent of the diameter of the inset 42, so that the tooling plate 38 and bolster unit 24 are generally non-translatable horizontally. The tooling post 40 is configured to secure a plurality of bend dies 36, such as the triple stacked configuration of the illustrated embodiment, and presents an elongated member vertically projecting from the plate 38. The post 40 presents a cross-sectional configuration (e.g., a bifurcated circle, star, or "D"-shape, etc.) correlative to central openings defined by the bend dies 36, so that the bend dies 36 can be firmly slid into the illustrated co-axial configuration. In a preferred embodiment the bend dies can be stacked to a maximum height of approximately 75 cm (or 30 in.).

Figure 7:
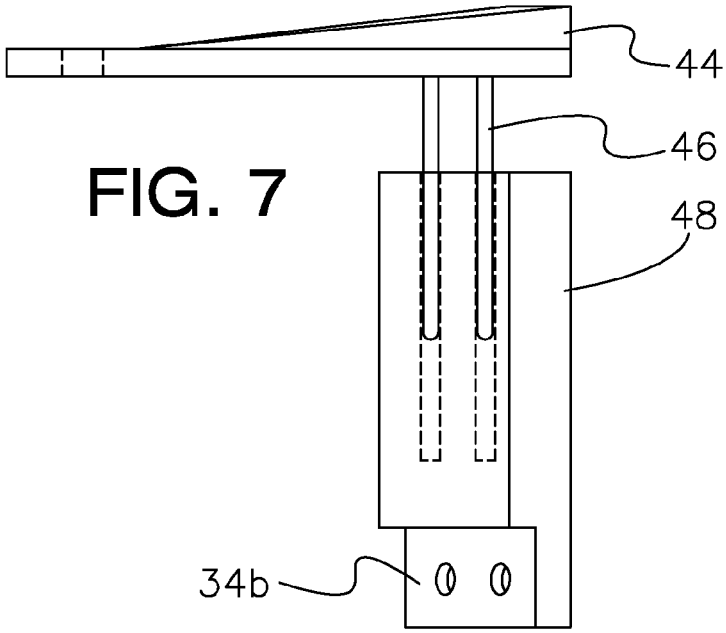
FIG. 7 is an elevation view of the bend die tower unit, in accordance with a preferred embodiment of the invention, wherein the bend tower unit comprises separate horizontal and vertical legs.

The preferred bend die tower unit 34 presents an "L"-shaped structural member or framework for supporting the upper or distal end of the post 40 during bending. The tower unit 34 is fixedly connected to the bolster unit 24, and rotatably coupled to the post 40 (FIGS. 4 through 6), so as to enable the rotation of the bend die mounting unit 16 while providing support. At the post-engaging end, the tower unit 34 defines a post receiving opening 34*a* (FIG. 2) that receives the post 40, and is sized relative to the post 40 to meet a minimum lateral clearance tolerance (e.g., 1 mm), so as to prevent excessive post deflection. At the opposite end, the tower unit 34 preferably presents a bolster engaging seat 34*b* that increases the surface area of engagement to provide a more rigid connection (FIGS. 2 and 7). Finally, so as to facilitate bend die replacement, the tower unit 34 may alternatively present a two-part structure, wherein a separate upper horizontal post engaging leg 44 defines two male prongs 46, and a vertical tower leg 48 defines two prong receiving female receptacles (FIG. 7), as it is appreciated that the tower unit 34 experiences minimal vertically applied forces during operation.

As best shown in FIG. 3, the wiper die mounting unit 22 secures a wiper die 50 adjacent the applicable or selected bend die 36. The wiper die mounting unit 22 positions the wiper die 50 along the tube groove of the selected bend die 36 behind the tangent point of bending (i.e., the initial contact point between the tube 14 and the bend die 36, where the bending force is applied and the tube is compressed). The wiper die 50 presents a distal end configured to enable the rotation of the bend die 36 while abutting the die 36 near the tangent point of bending. More particularly, the wiper die 50 presents a curved end having a radius of curvature slightly larger than the radius of curvature of the bend die 36, so that the bend die 36 can slidably rotate without translating the wiper die 50. It is appreciated that properly positioning the wiper die 50 helps control the surface quality of the tube 14 on the inside of the bend.

More preferably, where a plurality of stacked bend dies 36 are included, the preferred wiper die mounting unit 22 includes an adjustable mechanism (e.g., lift) 52 that is fixedly attached to the bolster unit 24, and configured to raise or lower the wiper die 50 according to the selected bend die 36 (FIG. 5*a*). Alternatively, however, and as shown in FIG. 5, the wiper die mounting unit 22 may be configured to secure a plurality of wiper dies 50 in a stacked configuration equal in height to the stacked bend dies 36, so that a wiper die 50 is positionable adjacent each of the bend dies 36. Under either configuration, the preferred wiper die mounting unit 22 is further laterally adjustable so as to be properly positioned adjacent a plurality of differing bend die radii, and more preferably further perpendicularly adjustable, so as to engage tubes of varying dimension. In the case of a multiple wiper die configuration, each wiper die 50 is separately translatable to achieve proper positioning adjacent the particular coplanar bend die 36.

The clamp die mounting unit 18 includes a surface area 24*c* and at least one locating pin 24*l* (typ.) defined by the bolster unit 24 for properly positioning and mounting a shiftable clamp die tooling plate 54 (FIG. 2). The clamp die tooling plate 54 is configured to hold a clamp die 56 in position for connection to the bender 12. As is known in the art, the clamp die 56 preferably presents a lateral or tube engaging length equal to 3 times the O.D. of the tube 14, and functions to hold the tube 14 in position, while it is bent around the selected bend die 36. Where a shorter length is provided as shown in FIGS. 1 and 2, it is also known in the art to utilize a clamp insert 56*a* that matches the bend die stack 36. The bender 12 (or a satellite actuator) shifts the clamp die 56 into and out of the engaged condition shown in FIGS. 3 through 6. Also shown in FIGS. 1 and 2, the clamp die mounting unit 18 preferably presents an engagement prong 58 for interacting with and transferring the clamping force from the bender 12 or actuator. The preferred clamp die 56 or insert 56*a* defines a sufficient plurality of tube seats 60 and height to apply a clamping force to the tube 14, when the tube 14 is in either of the plurality of potential tube grooves or tracks defined in part by the plurality of bend dies 36, or concurrently to a plurality of tubes 14 in each of a plurality of defined grooves. The preferred plate 54 is configured to hold multiple clamp die shapes and sizes as required. The preferred clamp die mounting unit 18 also includes a mechanism (not shown) to lock it in place for safe transport on and off the bender 12. Finally, where the bend begins at or near a distal end of the tube 14, a conventional clamp plug (also not shown) may alternatively be utilized in connection with the bolster unit 24.

Like the clamp die mounting unit 18, the pressure die mounting unit 20 includes an area 24*p* and at least one locating pin 24*l* defined by the bolster unit 24, and a pressure die mounting plate 62 for securing a pressure die 64 (FIGS. 1 and 2). The plate 62 is shiftable into and out of the engaged condition, wherein the pressure die 64 applies further holding and bending counter-forces to the operably positioned tube 14. The pressure die mounting unit 18 is configured so that the pressure die 64 is positioned adjacent the clamp die 56 prior to bending, and presents a sufficient lateral length to apply pressure to a minimum section of the tube 14. It is appreciated in the art that the pressure die 64 functions to control tube stretch and surface quality during bending. The preferred plate 62 is configured to secure a variety of pressure die configurations and lengths as required. Finally, like the clamp unit 18, a mechanism (not shown) is preferably provided to lock the pressure die mounting unit 20 in place for safe transport on and off the bender 12.

The novel bolster unit 24 preferably presents a durable planar structure that overlays at least a portion of the top of the bender 12. As best shown in FIG. 2, the bolster unit 24 of assembly 10 presents a general key-shaped planar configuration, wherein a rectangular section 66 extends from a wider circular or polygonal shaped main section 68 that provides structural support and mounting surfaces for the remaining units. The bolster unit 24 is configured to enable the engagement of the drive mechanism 12*a* and bend die mounting unit 16, and as such defines the previously mentioned inset 42 that exposes the tooling plate 38 to the bender 12. The preferred bolster unit 24 is connectable to the bender 12 by conventional methodology (e.g., one or more clamps, or tapped bosses/bolts) that is easily removable by an operator. However, it is appreciated that as a result of the bending and holding forces applied by the bender 12 to the tube 14 and assembly 10, the bolster unit 24 need not be further connected to the bender 12 as the forces are efficiently used to bend the tube 14, and sufficient to hold the assembly 10 in place.

Near the trailing end of the tube 14, the preferred bolster unit 24 also defines in part the mandrel saddle unit 26 and the collet saddle unit 28 (FIG. 2). The mandrel saddle unit 26 includes surface area 24*m* that forms a concave saddle that receives and properly positions the mandrel assembly 30 for connecting to the bender 12. The mandrel assembly 30 includes a mandrel (not shown), which, as further appreciated in the art, is inserted within and supports the inside diameter of the tube 14 to control collapse and stretching in the bend area.

Like the mandrel saddle unit 26, the collet saddle unit 28 is defined in part by an area 24*o* on the rectangular section 66 of the bolster unit 24 (FIG. 2), where the collet 32 is stored for connection to the bender 12. As is also appreciated in the art, the collet 32 is configured to grip the end of the tube 14, so as to hold and position the tube 14 for bending, establish the distance between bends, and set the plane of the bend.

Finally, as shown in FIG. 6, the preferred assembly 10 further includes a first bearing set 70 intermediate the bend mounting unit 16 and bolster unit 24, and a second bearing set 72 intermediate the bend mounting unit 16 and tower unit 34, so as to reduce frictional energy loss between the adjacent unit surfaces. In this embodiment, the bearing sets 70,72 are depicted as ball bearings in raceway; however, it is appreciated that a fluid, or more preferably solid lubricant (not shown) can be utilized intermediate the relatively moving surfaces instead of the bearing sets 70,72.

In FIGS. 8 through 12*a*, a second preferred embodiment of the present invention is presented by assembly 100, wherein a bend die tooling stack 110 is mounted on a bend tooling plate 122, and functions to transmit the C-axis torque generated by the bender 12 to the tube 14. As best shown in exploded FIG. 9, the bend die tooling stack 110 may present a three bend die stack, or any other configuration required by a given tube geometry that is supported by the assembly 100. A wiper die holder unit 112 is configured to properly locate wiper dies 50 adjacent the bend die tooling stack 110 (FIGS. 8 through 10) for reasons previously described with respect to assembly 10. The wiper die holder unit 112 stays rigidly connected to the bolster plate unit 134, but is preferably adjustable, so as to suit the entire range of bend tooling configurations supported by the assembly 100 (FIG. 12*a*).

Figure 8:
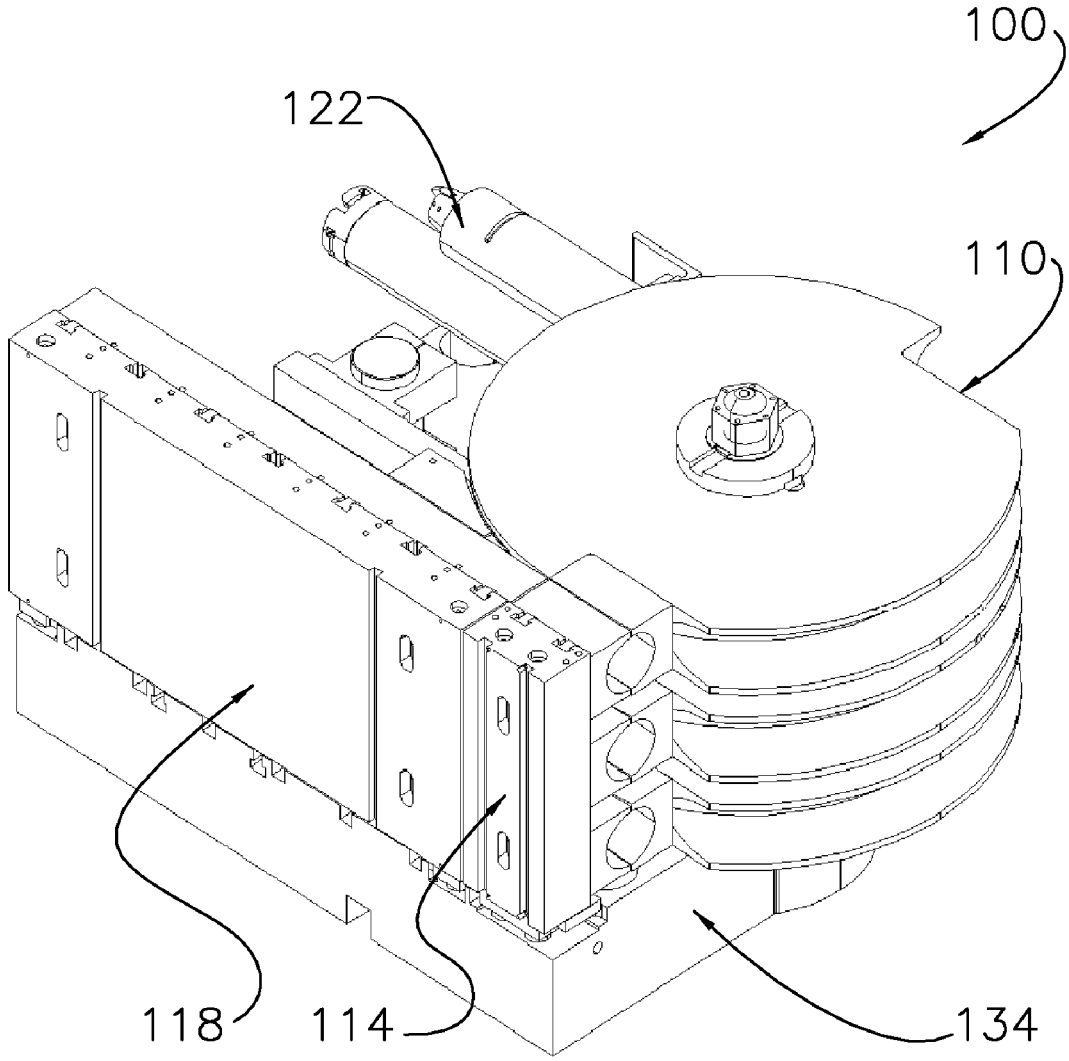
FIG. 8 is a perspective view of a tool bending assembly for use with a rotary draw bender, in accordance with a second preferred embodiment of the invention.
Figure 9:
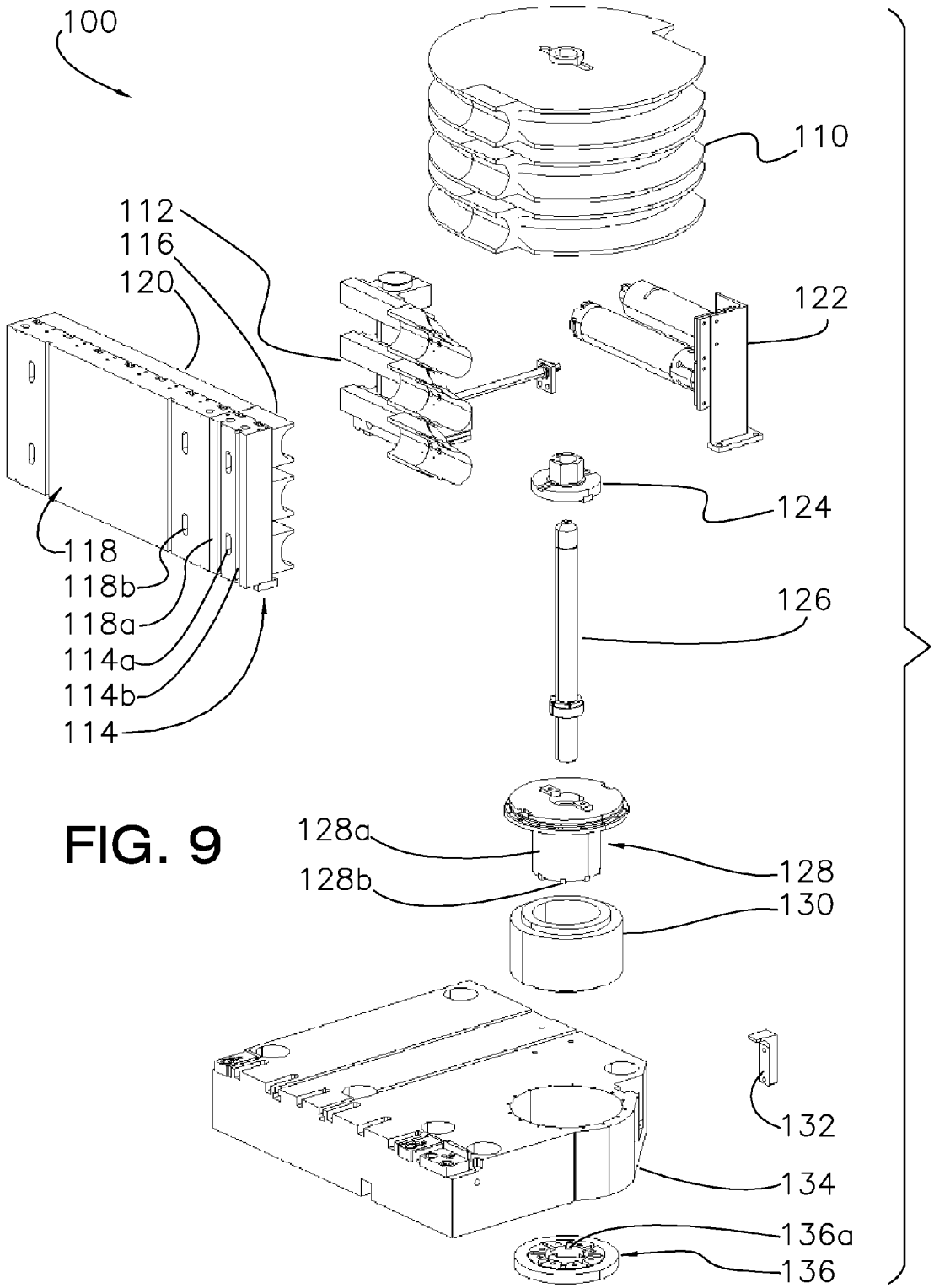
FIG. 9 is an exploded view of the assembly shown in FIG. 8, particularly illustrating the interrelation of a bend die stack, bolster plate unit, clamp die mounting unit, wiper die mounting unit, pressure die mounting unit, dual mandrel and collet mounting unit, bend die post, bend die post securing nut, bolster bearing, and drive plate.

A clamp die mounting unit 114 defines two vertical keyways 114*a* and two vertical slots 114*b* flanking the keyways 114*a* (FIGS. 8 through 10). Together the keyways 114*a* and slots 114*b* cooperatively serve as a universal connection point to the driven bend arm (not shown) of the bender 12 or satellite actuator, as well as a universal mounting for most conventional configurations of clamp die tooling 116. As shown in FIGS. 8, 10 and 12 pressure die mounting unit 118 is preferably positioned adjacently left of the clamp die mounting unit 114 prior to bending, and likewise presents two vertical keyways 118*a* and four vertical slots 118*b* flanking the keyways 118*a*. Together the pressure die mounting unit keyways 118*a* and slots 118*b* cooperatively serve as a universal connection point to the pressure die unit (also not shown) of the bender 12, and a universal mounting for most conventional configuration of pressure die tooling 120.

As best shown in FIG. 9, a mandrel and collet mounting unit 122 is provided to dually engage a mandrel and collet during transport, connection and disconnection to and from the bender 12. The dual unit 122 is set up to accommodate most conventional configurations of mandrels and collets supported by the assembly 100. The mandrel and collet mounting unit 122 is rigidly connected to the bolster plate unit 134, as can be further seen in FIGS. 10*a* and 12*a*. It is appreciated that in this stacked configuration, the dual nature and positioning of the unit 122 provides a more efficient spatial configuration for storing and locating the mandrel 30 and collet 32, which thereby reduces the overall size of the bolster plate unit 134, in comparison to assembly 10.

Figure 11:
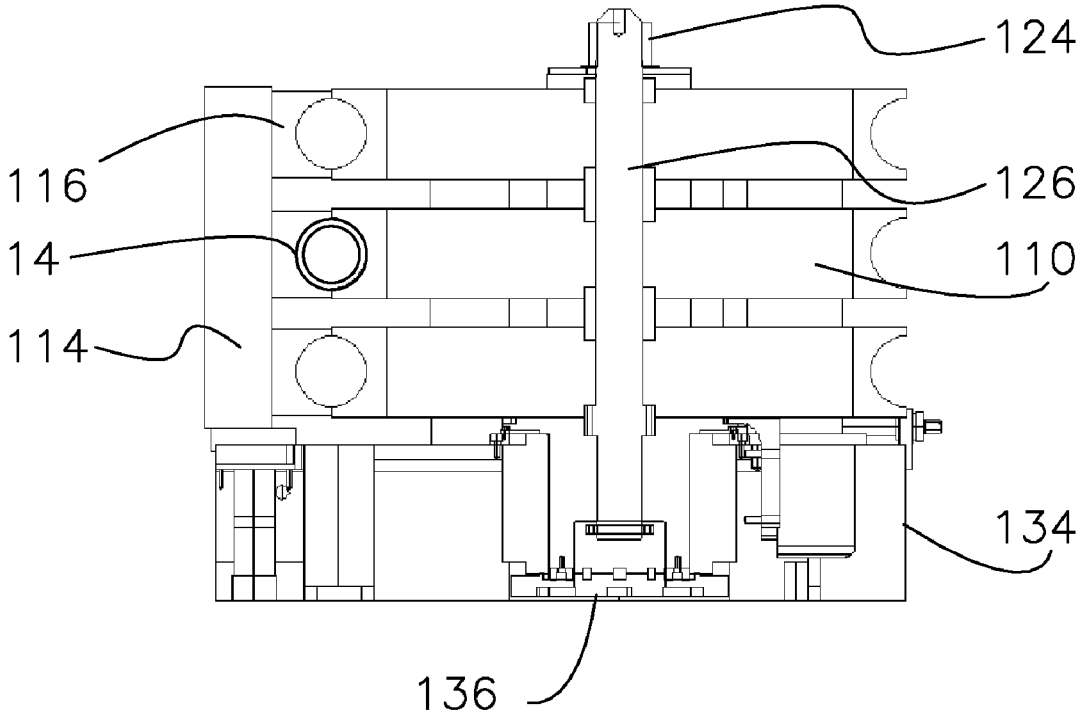
FIG. 11 is a cross-section of the assembly shown in FIG. 8, particularly illustrating the interconnected bend die nut, post, stack, and drive plate.

In the illustrated embodiment of assembly 100 an equivalent to the bend die tower unit 34 is not provided. Instead, a tool post nut 124 is used in conjunction with a tool post 126 to hold the bend die tooling stack 110 in a generally fixed position (i.e., with minimal deflection) relative to a bend tooling plate 128 (FIGS. 9 and 11). The nut 124 and post 126 cooperatively transmit the clamping and pressure forces from the bender 12 to a bolster bearing 130, exemplarily shown as a solid ring bearing in FIG. 9. The bend tooling plate 128 serves as a universal mounting for most conventional configurations of bend die tooling stacks 110 supported by the assembly 100. The bend tooling plate 128 transmits the C-axis torque from a bolster drive plate 136 (FIGS. 9 and 11) to the bend die tooling post 126 and stack 110. It is further appreciated that through its connection to the bolster drive plate 136, the bend tooling plate 128 sets the preload for the bolster bearing 130. The bolster bearing 130 reduces energy loss during rotational displacement between the bend die tooling stack 110 and the bolster unit 134, allows the bender 12 to transmit the bending torque to the tube 14, and provides the reaction force to the clamp and pressure die forces.

Also shown in FIG. 9, a bend tooling lock 132 is included in preferred assembly 100 to locate and lock the bend tooling plate 128 during transport, connection and disconnection to and from the bender 12, so as to eliminate set-up errors. To enable the functional rotation of the bend stack 110, the lock 132 is removed prior to bending.

Similar to assembly 10, the bolster plate unit 134 properly locates and interconnects the other components of assembly 100 for connection and disconnection to and from the bender 12, and is preferably connected to the bender 12 during bending. It further provides universal mounting for all the components of an entire bend tooling set (e.g., the wiper, pressure, clamp, and bend die stacks) to the bender 12 for any bend tooling configuration supported by the assembly 100.

Finally, as previously mentioned, the bolster drive plate 136 functions to connect the bend tooling plate 128 to the C-axis of the bender 12 (FIG. 11). The drive plate 136, therefore, transmits torque generated by the drive mechanism 12*a* to the bend die tooling stack 110 through the bend tooling plate 128. More particularly, and as shown in FIG. 9, where the bend tooling plate 128 includes bearing insert portion 128*a* and a plurality of engaging gear teeth 128*b* at the distal end of the insert portion 128*a*, the drive plate 136 defines an equal plurality of notches 136*a* configured to receive the teeth 128*b*, in such a manner as to preferably form superjacent layers when the insert portion 128*a* is placed within the bearing 130. It is appreciated that the teeth and notch configuration promotes unitary displacement between the bend tooling and drive plates 128,136, as well as greater force transfer.

The preferred forms of the invention described above are to be used as illustration only, and should not be utilized in a limiting sense in interpreting the scope of the present invention. Obvious modifications to the exemplary embodiments and modes of operation, as set forth herein, could be readily made by those skilled in the art without departing from the spirit of the present invention. The inventors hereby state their intent to rely on the Doctrine of Equivalents to determine and assess the reasonably fair scope of the present invention as it pertains to any apparatus, assembly, or method not materially departing from but outside the literal scope of the invention as set forth in the following claims.

What is claimed is:

1. An assembly adapted for use with a tube bending machine having a drive mechanism, and for bending at least one operably positioned tube, said assembly comprising:

a bend die mounting unit configured to secure at least one bend die in a fixed position relative thereto;

a clamp die mounting unit configured to secure a clamp die in a fixed position, wherein the clamp die is operable to produce a holding force against the tube;

a pressure die mounting unit configured to secure a pressure die in a fixed position generally adjacent the clamp die;

a wiper die mounting unit configured to secure at least one wiper die in a fixed position opposite the pressure die, such that said bend, clamp, pressure and wiper dies are cooperatively configured to hold the tube in the operable position, cause the tube to bend, and control tube stretching and surface deformation during bending, when drivenly coupled to the mechanism and the machine is actuated;

a bolster unit rotatably connected to the bend die mounting unit, fixedly connected to the clamp, pressure and wiper die mounting units, and removably connectable to the machine, so as to enable the concurrent connection or disconnection of the assembly from the machine as a whole; and a mandrel saddle unit including a surface area for mounting and at least one locating pin for properly positioning a mandrel assembly, wherein the area and pin are defined by the bolster unit, said mandrel assembly stored within the mandrel saddle unit and including a mandrel slidably insertable within the tube, so as to support the tube during bending.

2. The assembly as claimed in claim 1, wherein said bend die mounting unit is configured to secure a plurality of bend dies, said bend dies are stacked vertically relative to the bolster unit, and said clamp die has a height dimension not less than the height of the stacked bend dies, so as to be capable of applying a holding force to the tube when the tube is adjacent either of the bend dies.

3. The assembly as claimed in claim 2, wherein each of said plurality of bend dies presents a different radius of curvature, and said bend, clamp, pressure and wiper die mounting units are cooperatively configured to produce a compound bend in the tube, without being disconnected from the bolster unit.

4. The assembly as claimed in claim 2, wherein said wiper die mounting unit includes an adjustable mechanism configured to raise or lower the wiper die to the height of a selected one of the bend dies.

5. The assembly as claimed in claim 2, wherein said wiper die mounting unit is configured to secure a plurality of wiper dies in fixed positions, and said wiper dies are separately adjustable.

6. The assembly as claimed in claim 1, wherein said clamp die mounting unit includes a clamp die tooling plate and a locking mechanism for connecting the clamp die tooling plate to the bolster unit, said bolster unit defines at least one locating pin for properly locating the clamp die tooling plate, and said clamp die tooling plate is configured to hold the clamp die in a fixed position relative thereto.

7. The assembly as claimed in claim 6, wherein said clamp die mounting unit further defines pluralities of keyways and vertical slots, and is universally configured to hold a plurality of clamp dies of differing shapes and sizes in a fixed position relative thereto.

8. The assembly as claimed in claim 1, wherein said pressure die mounting unit includes a pressure die tooling plate and a locking mechanism for fixedly connecting the pressure die tooling plate to the bolster unit, said bolster unit defines at least one locating pin for properly locating the pressure die tooling plate, and said pressure die tooling plate is configured to hold the pressure die in a fixed position relative thereto.

9. The assembly as claimed in claim 8, wherein said pressure die mounting unit further defines pluralities of keyways and vertical slots, and is universally configured to hold a plurality of pressure dies having differing lengths in a stacked configuration.

10. The assembly as claimed in claim 1, wherein said machine is a CNC tube bender.

11. An assembly adapted for use with a tube bending machine having a drive mechanism, and for bending at least one operably positioned tube, said assembly comprising:

a bend die mounting unit configured to secure at least one bend die in a fixed position relative thereto;

a clamp die mounting unit configured to secure a clamp die in a fixed position, wherein the clamp die is operable to produce a holding force against the tube;

a pressure die mounting unit configured to secure a pressure die in a fixed position generally adjacent the clamp die;

a wiper die mounting unit configured to secure at least one wiper die in a fixed position opposite the pressure die, such that said bend, clamp, pressure and wiper dies are cooperatively configured to hold the tube in the operable position, cause the tube to bend, and control tube stretching and surface deformation during bending, when drivenly coupled to the mechanism and the machine is actuated;

a bolster unit rotatable connected to the bend die mounting unit, fixedly connected to the clamp, pressure and wiper die mounting units, and removably connectable to the machine, so as to enable the concurrent connection or disconnection of the assembly from the machine as a whole; and a collet saddle unit including a surface area for mounting and at least one locating pin for properly positioning a collet, wherein the area and pin are at least partially defined by the bolster unit, said collet being stored within the collet saddle unit and configured to engage the end of the tube, so as to hold the tube in the operable position.

12. The assembly as claimed in claim 1, further comprising:

a bearing set intermediate the bend die mounting and bolster units.

13. The assembly as claimed in claim 1, wherein said bend die mounting unit includes an elongated tooling post having a distal end, and said at least one bend die defines a central opening configured to receive at least a portion of the post.

14. The assembly as claimed in claim 13, further comprising:

a bend die tower unit connected to the bolster unit, rotatably coupled to the tooling post at or near the distal end, and configured to horizontally support the post.

15. The assembly as claimed in claim 14, further comprising:

a first bearing set intermediate the bend die mounting and bolster units; and a second bearing set intermediate the bend die mounting and tower units, said first and second bearing sets being configured to reduce friction between the adjacent units when the machine is actuated.

16. The assembly as claimed in claim 13, wherein the machine includes a C-axis drive mechanism that generates torque when the machine is actuated, and the assembly further comprises a drive plate configured to connect the bend die mounting unit to the mechanism and transmit the torque to the bend die mounting unit.

17. An assembly adapted for use with a tube bending machine having a drive mechanism, and for bending at least one operably positioned tube, said assembly comprising:

a bend die mounting unit configured to secure at least one bend die in a fixed position relative thereto;

a clamp die mounting unit configured to secure a clamp die in a fixed position, wherein the clamp die is operable to produce a holding force against the tube;

a pressure die mounting unit configured to secure a pressure die in a fixed position generally adjacent the clamp die;

a wiper die mounting unit configured to secure at least one wiper die in a fixed position opposite the pressure die, such that said bend, clamp, pressure and wiper dies are cooperatively configured to hold the tube in the operable position, cause the tube to bend, and control tube stretching and surface deformation during bending, when drivenly coupled to the mechanism and the machine is actuated;

a bolster unit rotatable connected to the bend die mounting unit, fixedly connected to the clamp, pressure and wiper die mounting units, and removably connectable to the machine, so as to enable the concurrent connection or disconnection of the assembly from the machine as a whole, said bolster unit including an inset region defining a planar circular shape having a first diameter, and said bend die mounting unit including a bend die tooling plate presenting a circular shape having a second diameter within the range of 95 to 99 percent of the first diameter, so that the bend die tooling plate is generally not horizontally translatable relative to the bolster unit.

* * * * *